US006129322A

United States Patent [19]

Merkl

[11] Patent Number: 6,129,322

[45] Date of Patent: Oct. 10, 2000

[54] HAND PUMP SUPPORT

[76] Inventor: Tim W. Merkl, 3200 W. Main St., Appleton, Wis. 54911

[21] Appl. No.: 09/034,093

[22] Filed: Mar. 3, 1998

[51] Int. Cl.[7] ..... A47B 96/06

[52] U.S. Cl. ..... 248/213.2; 248/231.71; 248/534; 248/539; 248/674; 417/360

[58] Field of Search ..... 248/213.2, 674, 248/231.71, 539; 417/360

[56] References Cited

U.S. PATENT DOCUMENTS

| | | | |
|---|---|---|---|
| 1,006,994 | 10/1911 | Barnes | 248/213.2 X |
| 1,712,450 | 5/1929 | Cuno | 248/231.71 X |
| 2,686,029 | 8/1954 | Raymond | 248/539 |
| 2,920,855 | 1/1960 | Giebel | 248/534 X |
| 3,542,209 | 11/1970 | Thompson | 248/213.2 X |
| 4,040,586 | 8/1977 | Newsteder | 248/674 |
| 4,371,099 | 2/1983 | Foster et al. . | |
| 4,496,085 | 1/1985 | Ford et al. . | |
| 4,867,653 | 9/1989 | Mills et al. | 417/360 |
| 4,872,816 | 10/1989 | Fetcko . | |
| 4,931,245 | 6/1990 | Schneider et al. . | |
| 5,102,304 | 4/1992 | Renn . | |
| 5,158,438 | 10/1992 | Olson et al. . | |
| 5,161,764 | 11/1992 | Roney | 248/231.71 |
| 5,356,105 | 10/1994 | Andrews | 248/674 X |
| 5,775,651 | 7/1998 | Jackovich | 248/213.2 |
| 5,807,079 | 9/1998 | Wilson | 417/360 |

*Primary Examiner*—Ramon O. Ramirez
*Assistant Examiner*—Tan Le
*Attorney, Agent, or Firm*—Andrus, Sceales, Starke & Sawall, LLP

[57] ABSTRACT

A pump support device for use in securing a hand pump within an opening formed in an upper wall of a container, such as a drum, for dispensing the contents of the container. The pump support device includes a base member defining an internal passage within which a body portion of the hand pump is received. The base member is configured so as to overlie the opening in the upper wall of the container, and a releasable engagement member, such as a thumb screw, is interconnected with the base member for selectively fixing the pump body in position relative to the base member. A mounting arrangement is interconnected with the base member for engaging a lip of the container for selectively securing the base member in position. The mounting arrangement includes an arm extending outwardly from the base member and terminating in a downturned outer end portion located outwardly of the lip. A tab member is secured to the arm inwardly of the downturned outer end portion, to define a space therebetween within which the lip is received. An engagement member, such as a thumb screw, is mounted to the downturned outer end portion of the arm for selectively clamping the lip against the tab member to releasably mount the base member relative to the container. A grounding wire is mounted to the thumb screw and is interconnected with a grounding clamp, for grounding the container.

14 Claims, 1 Drawing Sheet

HAND PUMP SUPPORT

BACKGROUND OF THE INVENTION

This invention relates to hand pumps used in dispensing liquids from rigid, enclosed containers. More specifically, the invention relates to a device for securing a hand lift stroke pump to a container.

Many types of liquids are contained within and transported using metal drums. These drums are very useful in transporting these liquids due to the durability of the drums and the resulting prevention of leaks from damage done to the drums during transportation. These drums are normally cylindrical in shape, with a top and bottom lid permanently connected on either end of a cylindrical body. The top lid of a drum typically has a bung disposed within a bung opening that allows access to the contents of the container. In larger drums, this bung opening is a threaded opening extending upwards from the surface of the upper lid. Bungs used on these size drums have matching threads allowing them to be screwably mounted into the bung opening. Similarly, a pump for use in dispensing the liquid contents of the drum includes a threaded mating collar mountable to the threads of the bung opening. This mating collar ensures that the pump will be securely connected to the drum.

This type of threaded mating collar is not applicable for use on smaller drums, such as a five gallon drum, as the bung opening in such a drum typically has no threads mateable with the threads on the mating collar. Therefore, other methods for securely attaching a pump to the exterior of a smaller drum have been developed. One of these methods involves a securing rod extending downward from the spigot of the pump along the exterior of the drum. The lower end of the securing rod ends in a hook placed underneath the lower edge of the drum. When the drum is placed on a flat surface, the weight of the drum rests on the hook to produce a stabilizing effect on the spigot for the hand pump.

One problem with this arrangement is that the drum need be placed on a completely level surface for the drum to rest securely on the hook. Furthermore, as the securing rod and hook only prevent the pump from being pulled out of the bung opening of the drum, the pump still is able to move laterally within the bung opening, and this movement may make efficient use of the hand pump difficult, as the pump may continually slide to either side during use. The arrangement also involves problems in attaching the securing rod to the drum, in that the entire drum must be lifted at one end after the pump has been inserted into the bung opening to allow for the hook to be slid underneath the lower edge of the drum. Five gallon drums, while not being as large or heavy as 15 or 55 gallon drums, still weigh a considerable amount and the danger of having fingers and/or toes caught underneath the drum during attachment of the hook to the lower edge of the drum cannot be discounted.

BRIEF SUMMARY OF THE INVENTION

It is an object of the present invention to provide a hand pump support that securely holds a hand pump in a stationary position within a bung opening of a liquid container drum. It is another object of the present invention to provide a hand pump support that is easily and safely attachable and removable from both the drum and the hand pump. Another object of the invention is to provide a hand pump support that is simple in its components and construction, yet which functions effectively to maintain the hand pump in position relative to the bung opening.

In accordance with one aspect of the invention, a device for mounting a hand pump, having an axially extending body, to a liquid container having an upper wall with an opening formed therein and a lip adjacent the upper wall, includes a base member adapted for placement over the opening and defining a passage to receive the hand pump body, and a releasable mounting arrangement interconnected with a base member that is engageable with the lip for releasably mounting the base member over the opening in the container. The base member includes a lower portion sized to cover the container opening and an upper tubular portion extending upwardly from the lower portion. The passage in the base member extends through both the upper tubular portion and the lower portion. A threaded member is threadably engaged with the upper tubular portion and extends into the passage to engage and secure the hand pump body to the base member. The releasable mounting arrangement includes a mounting arm extending laterally from the base member and a releasable engagement arrangement on the mounting arm opposite the base member for releasable engagement with the container lip. The releasable engagement arrangement includes a pair of spaced members depending from the mounting arm and defining a space for receiving the container lip. A threaded member is threadably engaged with a first one of the spaced members and is oriented in the first spaced member to clamp the container lip between one end of the threaded member and a second one of the spaced members when the threaded member is rotated relative to the first spaced member. The pair of spaced members are formed by a downturned outer end portion of the mounting arm and a tab member extending downwardly from the mounting arm and spaced inwardly of the downturned outer end portion of the mounting arm. The threaded members, located in the upper tubular portion of the base member and the downturned outer end portion of the mounting arm, are each preferably in the form of a thumb screw threadably engaged with the upper tubular portion and the downturned outer end portion, respectively. A grounding arrangement is interconnected with the threaded member located in the downturned outer end portion and is used to ground the liquid container.

In accordance with, another aspect of the invention, the lower portion of the base member comprises a washer on which the upper tubular portion of the base member is centered. The mounting arm is secured to the washer adjacent the upper tubular portion and comprises a rectangular bar. The washer, upper tubular portion and mounting arm are all made from metal and secured by welding the individual pieces to each other.

The invention further contemplates a method of securing a hand pump to a liquid container substantially in accordance with the foregoing description.

Various other features, objects and advantages of the invention will be made apparent from the following detailed description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
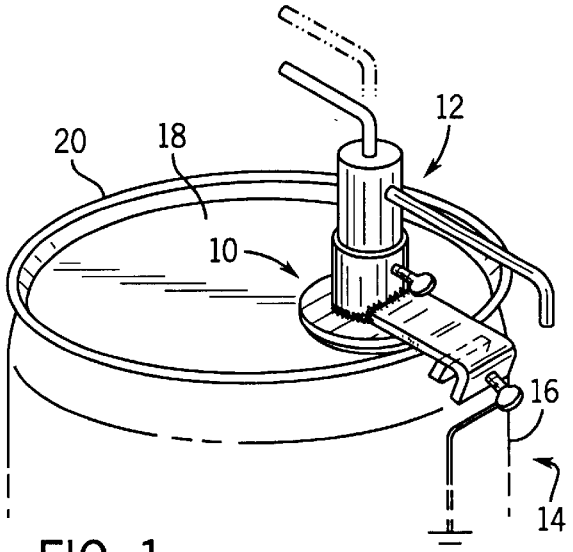
FIG. 1 is a partial isometric view of a hand pump attached to a container drum using a pump support constructed according to the present invention.
Figure 2:
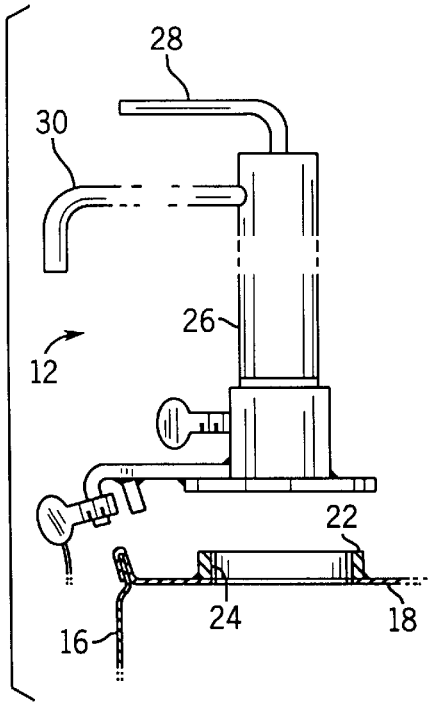
FIG. 2 is an exploded side elevation view of the pump support, the hand pump and the container drum of FIG. 1.
Figure 3:
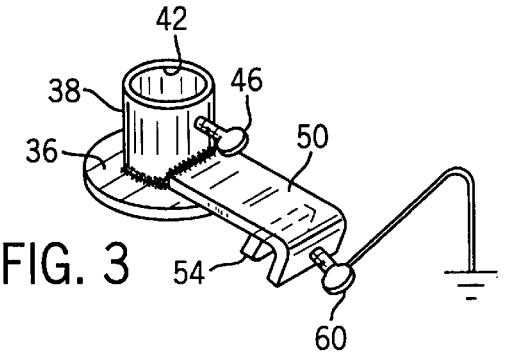
FIG. 3 is an isometric view of the pump support shown in FIG. 1.
Figure 4:
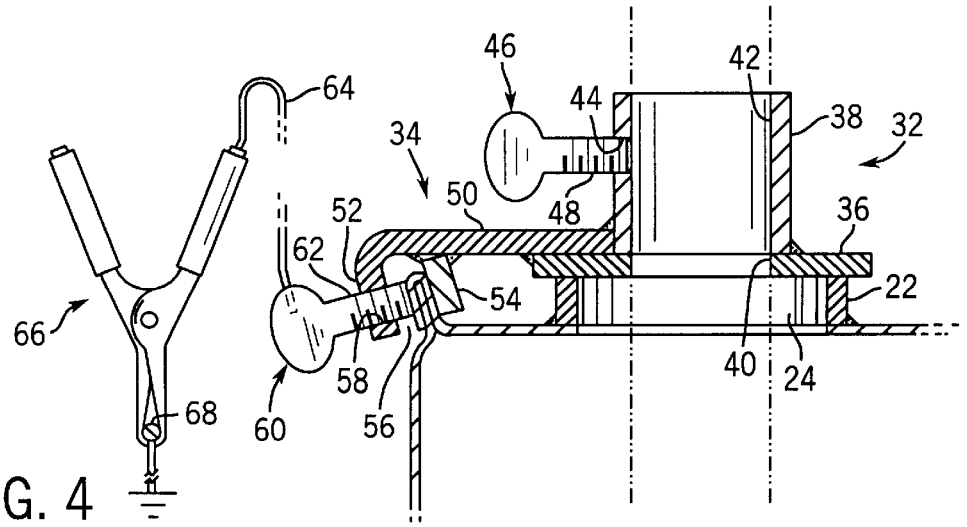
FIG. 4 is a cross-sectional view of the pump support of FIGS. 1–3 attached to the container drum and covering the bung opening in the container drum.

FIG. 1 illustrates a pump support device 10 constructed according to the invention, for securing a hand pump assembly 12 to a container 14. Container 14 is generally in the form of a drum having a side wall 16, an upper wall 18, and an upstanding peripheral lip 20 which interconnects side wall 16 and upper wall 18. As shown in FIGS. 2 and 4, a bung 22 is mounted to container upper wall 18, defining a bung opening 24 which communicates with the interior of container 14. Container 14 is adapted to contain a volume of liquid, such as paint, for shipping and handling, during which a bung closure (not shown) is mounted to bung 22 for closing opening 24. The bung closure is removed when it is desired to gain access to the contents of container 14, as is known.

Hand pump assembly 12 includes a pump body 26, a pump handle 28 and a spigot 30. An intake tube (not shown) extends from the lower end of pump body 26, and has a length sufficient to reach the bottom of container 14 to provide liquid to pump body 26 in response to operation of handle 28 for dispensing through spigot 30. Hand pump assembly 12 is of conventional construction, and may representatively be a pump such as is available from First Ayd of Elgin Illinois under its Part No. 952-5, although it is understood that any other satisfactory pump assembly may be employed.

Pump support device 10 includes a base, shown generally at 32, and a releasable mounting arrangement shown generally at 34. Base 32 includes a lower plate-like member 36 and an upper tubular member 38 mounted to lower plate-like member 36 in any satisfactory manner, such as by welding. Lower plate-like member 36 has a size sufficient to cover bung opening 24 and to rest on the upper end of bung 22, and may be in the form of a circular washer member defining a central aperture 40. Upper tubular member 38 defines an internal passage 42 having substantially the same diameter as aperture 40 and in alignment therewith, such that aperture 40 and passage 42 cooperate to define an axially extending passage through base 32 having a sufficient size to enable pump body 26 to extend therethrough and into the interior of container 14. A threaded opening 44 is formed in upper tubular member 38. A thumb screw 46 includes a threaded shank 48 engaged with threaded opening 44.

Releasable mounting arrangement 34 includes an arm 50 defining an inner end mounted to base 32 and terminating in a downturned outer end 52. Arm 50 is mounted at an inner end to base 32 in any satisfactory manner, such as by welding to both upper tubular member 38 and to lower plate-like member 36. A tab member 54 is mounted to the underside of arm 50 at a location spaced inwardly from downturned outer end 52, and oriented generally parallel thereto. Again, tab member 54 may be mounted to arm 50 in any satisfactory manner, such as by welding.

Tab member 54 and downturned outer end portion 52 of arm 50 cooperate to define a downwardly facing space 56. Pump support device 10 is constructed such that the distance between space 56 and aperture 40 corresponds to the spacing between container lip 20 and bung 22 for a predetermined container size, such as a five gallon drum as shown.

A threaded opening 58 is formed in downturned outer end portion 52 of arm 50, extending generally perpendicularly to downturned outer end portion 52. A thumb screw 60 defines a threaded shank 62 in threaded engagement with threaded opening 58. A ground wire 64 is mounted at one end to the head of thumb screw 60, and is connected at its other end to a ground clamp 66.

In operation, pump support device 10 is operable to mount hand pump assembly 12 to container 14 as follows. After the user has removed the closure from bung 22 to expose bung opening 24, pump support device 10 is positioned relative to container 14 such that lower plate-like member 36 is placed over the upper end of bung 22 and such that container lip 20 is received within space 56 between tab member 54 and downturned outer end portion 52 of arm 50, as shown in FIGS. 1 and 4. The user then turns thumb screw 60 to advance the end of thumb screw shank 62 toward container lip 20, which functions to clamp container lip 20 between tab 54 and the end of thumb screw shank 62 to securely mount pump support device 10 to container 14. The user then inserts pump body 26 into and through passage 42 in upper tubular member 38 and aperture 40 of lower plate-like member 36, and adjusts the axial position of pump body 26 relative to base 32 to attain a proper position of the hand pump intake tube relative to the bottom of container 14. Once the proper position of hand pump assembly 12 is attained, the user turns thumb screw 46 to advance the end of threaded shank 48 toward pump body 26, which functions to frictionally engage pump body 26 with the internal wall of upper tubular member 38 defining passage 42 to prevent axial movement of pump body 26 relative to base 32. In this manner, hand pump assembly 12 is securely mounted in position relative to container 14. The user then engages ground clamp 66 with a ground, shown at 68, and hand pump assembly 12 is ready for operation to dispense the contents of container 14 through spigot 30 in response to operation of handle 28, in a manner as is known.

It can thus be appreciated that pump support device 10 provides a quick and efficient means for mounting a hand pump assembly to a container having an opening in an upper wall. Pump support device is simple in its components and is easy to operate both in mounting a hand pump assembly to a container and in removing a hand pump assembly from a container. Pump support device 12 provides an efficient and simple means for grounding the container by providing a positive engagement with the container using a threaded member, and by permanently mounting the grounding wire to the threaded member.

Various modes of carrying out the invention are contemplated as being within the scope of the following claims particularly pointing out and distinctly claiming the subject matter regarded as the invention.

I claim:

1. A device for mounting a hand pump having an axially extending body to a liquid container having an upper wall with an opening formed therein, wherein the container further includes a lip adjacent the upper wall and spaced from the opening, comprising:

a base member defining a passage and adapted for placement over the opening such that the passage is in communication with the opening, wherein the hand pump body is adapted to be received within the passage and to extend through the opening into the interior of the container;

a releasable mounting arrangement interconnected with the base member and adapted for engagement with the lip for releasably mounting the base member to the container such that the base member passage is located over the opening, wherein the mounting arrangement extends laterally from the base member and is adapted to span the space between the opening and the lip, and wherein the releasable mounting arrangement includes a first threaded member selectively engageable with the lip for selectively securing the base member in position relative to the liquid container a second threaded member threadedly engaged with the base member and extending into the passage, wherein the second threaded member is adapted to engage and secure the hand pump body to the base member; and a grounding arrangement interconnected with the first threaded member and adapted to ground the liquid container.

2. The device of claim 1, wherein the base member includes a lower portion sized so as to cover the opening, and an upper tubular portion extending upwardly from the lower portion.

3. The device of claim 1, wherein the releasable mounting arrangement comprises a mounting arm extending laterally from the base member, and wherein the first threaded member is interconnected with the mounting arm and adapted for releasable engagement with the lip.

4. The device of claim 3, further comprising a pair of spaced members depending from the mounting arm and defining a space therebetween adapted to receive the lip, and wherein the first threaded member is threadedly engaged with a first one of the spaced members, wherein the first threaded member is oriented so as to clamp the lip between an end portion of the threaded member and a second one of the spaced members upon turning the first threaded member relative to the first spaced member.

5. The device of claim 4, wherein the pair of spaced members comprises a downturned outer end portion of the mounting arm in combination with a tab member extending downwardly from the mounting arm and spaced inwardly of the downturned outer end portion.

6. The device of claim 5, wherein the first threaded member comprises a thumbscrew threadedly engaged with the downturned outer end portion of the mounting arm.

7. The device of claim 1, wherein the base member includes a tubular member defining the passage within which the hand pump body is adapted to be received, and wherein the first threaded engagement member is threadedly engaged with the tubular member and adapted for selective engagement with the hand pump body for releasably fixing the hand pump body in position relative to the tubular member.

8. The device of claim 1 wherein the base member includes a plate-like lower portion in the form of a washer.

9. The device of claim 1 wherein the grounding arrangement comprises a ground wire and a clamp.

10. A method of mounting a hand pump to a liquid container, wherein the hand pump includes an axially extending body portion, and wherein the liquid container includes an upper wall having an opening formed therein and further includes a lip spaced from the opening, comprising the steps of:

engaging the hand pump body portion within an axially extending passage defined by a base member by turning a screw member threadedly mounted to the base member into engagement with the hand pump body, wherein the base member further includes a mounting arrangement laterally extending from the base member and spanning the space between the opening and the lip;

placing the base member over the opening such that the hand pump body portion extends through the opening and into the interior of the container; and fixing the base member in position by engaging the mounting arrangement with the lip.

11. The method of claim 10, wherein the container includes a ring member mounted to the upper wall at the opening formed in the upper wall, and wherein the base member includes a lower portion, wherein the step of placing the base member over the opening is carried out by positioning the base member lower portion over the ring member such that the lower portion engages an upper end defined by the ring member, and wherein the lower portion is sized and configured so as to overlie the passage defined by the ring member in communication with the opening formed in the container upper wall.

12. The method of claim 10, wherein the step of fixing the base member in position by engaging the mounting arrangement with the lip is carried out by turning a threaded member, which is threadably engaged with the mounting arrangement, into engagement with the lip.

13. The method of claim 12, further comprising the step of grounding the container by connecting a grounding arrangement to the threaded member and connecting the grounding arrangement to ground.

14. The method of claim 12, wherein the mounting arrangement includes a pair of spaced members for receiving the lip therebetween, wherein the threaded member is threadably engaged with a first one of the spaced members, and wherein the step of turning the threaded member functions to clamp the lip between a second one of the spaced members and an end portion defined by the threaded member.

* * * * *